US005377452A

United States Patent [19]

Yamaguchi

[11] Patent Number: 5,377,452

[45] Date of Patent: Jan. 3, 1995

[54] GRINDER FOR GRINDING STAMPER USED FOR DISC MOLDING

[75] Inventor: Yoshihiro Yamaguchi, Kanagawa, Japan

[73] Assignee: Sony Corporation, Tokyo, Japan

[21] Appl. No.: 982,865

[22] Filed: Nov. 30, 1992

[30] Foreign Application Priority Data

Nov. 30, 1991 [JP] Japan ..... 3-342328
Nov. 30, 1991 [JP] Japan ..... 3-342329

[51] Int. Cl.[6] ..... B24B 21/06

[52] U.S. Cl. ..... 451/1; 451/306; 451/307; 451/11; 451/57

[58] Field of Search ..... 51/72 L, 97 R, 104, 51/106 R, 131.3, 131.4, 132, 144, 145 R, 165.75, 165.76, 165.77, 216 T, 237 R, 237 M, 326, 327, 328, 95 WH, 95 R, 88, 133, 147, 237 M

[56] References Cited

U.S. PATENT DOCUMENTS 4,964,242 10/1990 Ruble ..... 51/144
5,018,311 5/1991 Malagrino, Jr. ..... 51/145 R
5,193,314 3/1993 Wormley ..... 51/145 R

FOREIGN PATENT DOCUMENTS 0316160 12/1989 Japan ..... 51/132

*Primary Examiner*—Jack W. Lavinder
*Attorney, Agent, or Firm*—Limbach & Limbach

[57] ABSTRACT

A grinding apparatus for grinding a stamper for forming a signal recording part, of an information signal recording disc is disclosed. The grinding apparatus includes a turntable holding and rotationally driving the stamper and an abrasive head for bringing a mounting surface of the stamper opposite to its surface carrying projections and recesses for molding the signal recording part of the information signal recording disc into sliding contact with an abrasive member. The rotational velocity of the turntable is controlled depending on the position of the abrasive head with respect to the stamper for rendering the relative speed of sliding contact between the stamper and the abrasive member constant for uniform grinding of the mounting surface of the stamper uniformly across its inner and outer peripheries.

7 Claims, 7 Drawing Sheets

GRINDER FOR GRINDING STAMPER USED FOR DISC MOLDING

BACKGROUND OF THE INVENTION

This invention relates to a grinding apparatus for grinding a stamper used for molding a signal recording part of an information recording disc. More particularly, it relates to a grinding apparatus for grinding a reverse surface of the stamper carrying projections and recesses on its front surface for molding similar projections and recesses as pits and lands corresponding to the information signals.

There has hitherto been proposed an optical disc having a disk-shaped disc substrate on one major surface of which pits and lands corresponding to information signals are formed. The disc substrate of the optical disc is formed of light-transmitting synthetic resin, such as polycarbonate or polymethyl methacrylate. A reflecting film of e.g. aluminum is deposited on the major surface of the disc substrate, such as by vapor deposition or sputtering.

With such optical disc, the information signals are read by detecting the state of the pits and lands from the opposite major surface of the disc by optical means.

For molding the disc substrate, a stamper or master disc, having projections and recesses on its major surface, is employed. The stamper is a disk of nickel or a like metal having a diameter substantially equal to the diameter of the disc substrate. The projections and recesses formed on the major surface of the stamper correspond to the information signals formed as pits and lands on the stamper. However, the state of the projections and recesses on the substrate is reversed from that of the projections and recesses on the stamper.

The reverse surface of the stamper is a planar surface. The stamper is mounted on a planar base block in a metal mold unit in an injection molding apparatus so that the reverse surface is set On and supported by the base block. During the process of molding the disc substrate, the stamper is kept in pressure contact with the base block by an injection pressure of a material which forms the disc substrate.

If the reverse surface, the mounting surface, of the stamper has irregularities, the stamper is deformed to conform to the irregularities of the mounting surface so as to render it impossible to effect correct molding. For this reason, %he stamper mounting surface is ground to a smooth mirror surface by a stamper grinding apparatus.

The conventional stamper grinding apparatus has a turntable on which the stamper is set. The apparatus is rotated with the stamper held thereon. The stamper is held to the turntable with its mounting surface directed upwards.

The stamper grinding apparatus includes an abrasive member which is kept in sliding contact with the mounting surface of the turntable-mounted stamper. The abrasive member comprises an abrasive tape having hard fine grains deposited on a film-shaped substrate and a supporting member supporting the abrasive tape. An abrasive surface of the abrasive tape contacts the mounting surface of the stamper with a predetermined contact pressure. The abrasive member is supported for movement in a direction towards and away from the center of rotation of the turntable and in a direction parallel to the mounting surface of the stamper held on the turntable, that is in a direction spanning the inner and outer peripheries of the stamper.

With the above-described stamper grinding apparatus, when the stamper is rotated with the abrasive member contacting the mounting surface of the stamper, the abrasive member is brought into sliding contact with the mounting surface of the stamper for grinding the mounting surface. The abrasive member is moved across the inner and the outer peripheries of the stamper for grinding the mounting surface of the stamper in its entirety.

Meanwhile, with the above-described stamper grinding apparatus, the turntable is always rotated at a substantially constant angular velocity. Thus the relative speed of sliding contact between the abrasive member and the stamper is gradually changed across the inner and outer peripheries of the stamper.

Consequently, the amount of grinding per unit time, and hence the amount of wear caused to the abrasive tape differs between the inner and outer peripheries of the stamper. Thus, it is difficult with the above-described stamper grinding apparatus to grind the disc substrate across its inner and outer peripheries under a constant state. That is, if the amount of grinding is to be constant across the inner and outer peripheries of the stamper, it becomes necessary to change the grinding time for the inner periphery of the stamper from that for the outer periphery of the stamper such that it is difficult to grind the stamper to a desired uniform smoothness.

On the other hand, with the above-described stamper grinding apparatus, since the amount of wear caused to the abrasive tape per unit time differs at the inner and outer peripheries of the stamper, the grinding state is changed across the inner and outer peripheries of the stamper if the feed rate of the abrasive tape is kept constant.

Besides, since the abrasive tape used in the above-described stamper grinding apparatus is worn out with the progress in the grinding of the stamper, the abrasive tape is fed so that its used-up portion is taken up and its unused portion is kept in sliding contact with the stamper during grinding of the mounting surface of the stamper.

Another conventional practice in the stamper grinding apparatus has been to wobble the abrasive member radially of the stamper with a predetermined frequency and a predetermined small amplitude for increasing an area on the stamper that may be ground with the abrasive tape of a unit length, that is, for raising the grinding efficiency of the stamper. If the abrasive member is wobbled in this manner, the locus of movement of the abrasive member on the stamper is wobbled in the form Of waves meandering radially inwardly and outwardly of an arc of a circle having the center of the stamper as its center.

However, if the abrasive member is wobbled radially of the stamper in the above-described stamper grinding apparatus, true grinding apparatus must be structurally complicated.

On the other hand, if the abrasive member has a high weight, it is difficult to wobble the abrasive member at a high frequency, so that not only must the apparatus be complicated in structure but the grinding process cannot be executed speedily.

Above all , in a stamper grinding apparatus having plural grinding members (for rough finishing, semi-finishing and finishing), it is necessary to provide a wobbling mechanism for each of the abrasive members, thereby complicating the structure further. Besides, with the stamper grinding apparatus having plural abrasive members, it is difficult to provide for equal wobbling frequency and amplitude of the respective abrasive members, thus rendering it difficult to realize satisfactory grinding.

OBJECTS AND SUMMARY OF THE INVENTION

It is an object of the present invention to provide a stamper grinding apparatus whereby the mounting surface of a stamper used for molding a disc substrate of synthetic resin for an optical disc, which is opposite to the surface having projections and recesses, may be ground in its entirety as a uniform smooth surface.

It is another object of the present invention to provide a stamper grinding apparatus whereby the mounting surface of the stamper used for forming the disc substrate may be ground with high efficiency.

In accordance with the present invention, there is provided a grinding apparatus for grinding a stamper employed for forming a signal recording part of an information signal recording disc, comprising a turntable for holding and rotating the stamper, the stamper carrying thereon projections and recesses for subsequent molding of a correspondingly shaped signal recording surface of the information signal recording disc, rotating driving means for rotationally driving the turntable, abrasive means movable along the radius of the stamper held on and rotated by the turntable for being slidingly contacted with a mounting surface of the stamper, grinding position detecting means for detecting a position of the abrasive means on the stamper, and controlling means for controlling the rotational speed of the turntable based on the position of the abrasive means on the stamper as detected by the grinding position detecting means. The controller controls the rotational velocity of the turntable in such a manner that changes in the relative speed of sliding contact between the stamper and the abrasive member across the inner and outer peripheries of the stamper are produced only within a preset range.

In addition, the stamper grinding apparatus according to present invention comprises a rotating unit for rotating the turntable holding the stamper about an axis of rotation passing through the center of the stamper in a direction perpendicular to the major surface of the stamper, and a movement unit for moving the turntable in a plane parallel to the major surface of the stamper held on the turntable for causing the center of the turntable to describe a locus in the form of an arc of a circle.

Other objects and advantages of the present invention will become more apparent from the following description.

DETAILED DESCRIPTION OF THE PREFERRED EMBODIMENT

The stamper grinding surface according to the present invention is adapted for grinding a reverse surface of a stamper, the stamper has fine pits and lands corresponding to the information signals to be formed on one major surface of a disc substrate of an optical disc when molding the disc substrate. The disc substrate is formed of a light-transmitting synthetic resin material, such as polycarbonate or polymethyl methacrylate. The optical disc is completed by depositing a reflecting film of aluminum etc. on a major surface of the disc substrate, having the above-mentioned pits and lands thereon, by vapor deposition, sputtering or like means.

The stamper is in the form of a disc having a diameter approximately equal to that of the disc substrate. The stamper has projections and recesses on its surface corresponding to pits and lands formed on the disc substrate. These projections and recesses are reversed in profile from the pits and lands on the disc substrate, respectively.

Figure 5:
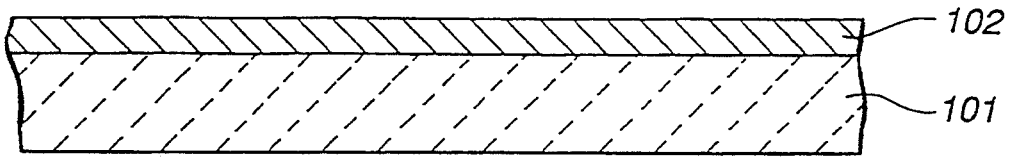
FIG 5 shows the production process for producing a stamper for an optical disc wherein the state in which a synthetic resin layer has been formed on a glass substrate is shown.
Figure 6:
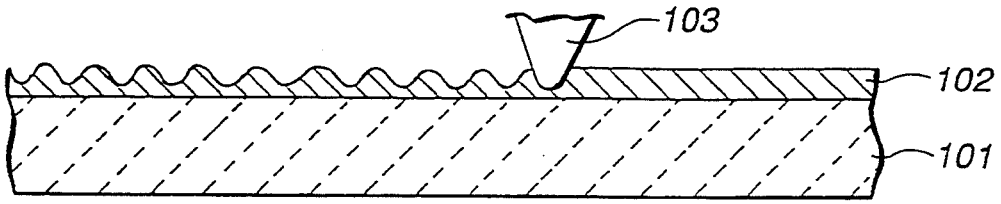
FIG. 6 shows the production process for producing a stamper for an optical disc wherein the state in which projections and recesses are formed on the synthetic resin layer is shown.
Figure 7:
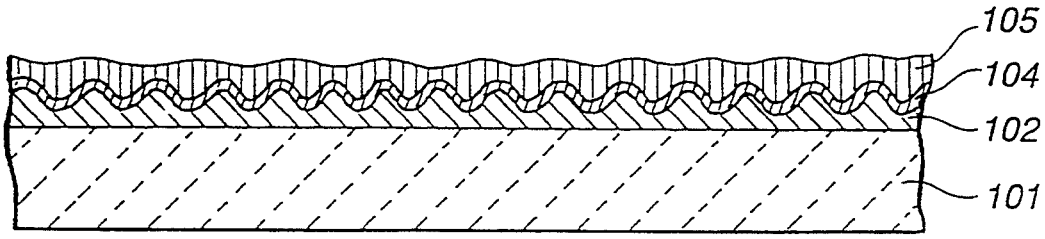
FIG. 7 shows the production process for producing a stamper for an optical disc wherein the state in which a plating layer is formed on the synthetic resin layer is shown.

Referring to FIGS. 5–7, the production process for producing the master disc is now briefly explained. For producing the master disc, a planar layer of synthetic resin 102 is first formed on a planar glass substrate 101, as shown in FIG. 5. The synthetic resin layer 102 may be formed of, for example, a UV curable resin. Projections and recesses corresponding to information signals are formed on the synthetic resin layer 102, using a laser beam 103 converged as shown in FIG. 6.

As shown in FIG. 7, metal layer 104 is then formed on the synthetic resin layer 102, carrying the projections and recesses thereon as described above, by so-called non-electrolytic plating or sputtering, and a plating layer 105 is formed on the metal layer 104 by, e.g., electroforming or plating. The metal layer 104 and the plating layer 105 are formed of a metal material, such as nickel.

Figure 8:
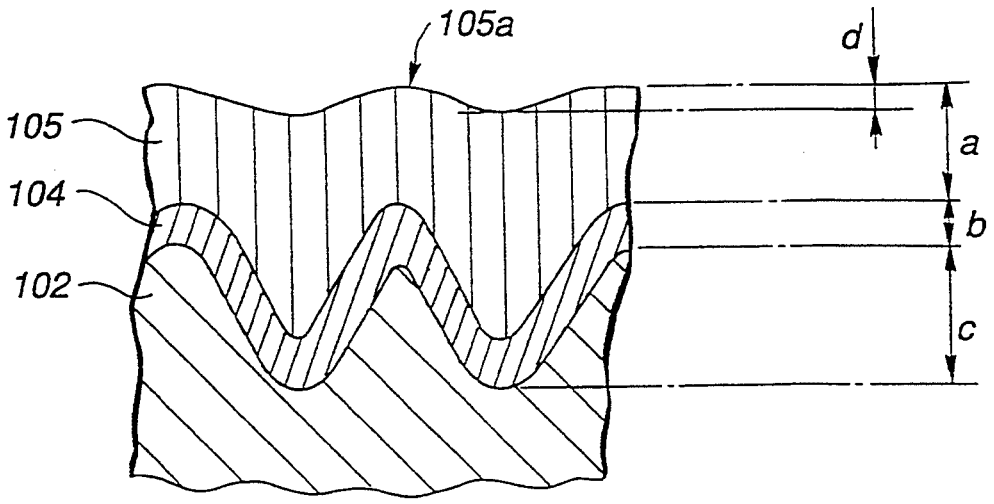
FIG. 8 shows the plating layer formed on the synthetic resin layer.

The synthetic resin layer 102, metal layer 104 and the plating layer 105 have boundary surfaces conforming to the projections and recesses corresponding to the information signals to be recorded, as shown in an enlarged view in FIG. 8. The average depth of the projections and recesses shown by arrow c in FIG. 8, average approximately 0.1 μm The average thickness f the metal layer 104, shown by arrow b in FIG. 8, is approximately 50 to 100 nm, while that of the plating layer 105, shown by arrow a in FIG. 8, is approximately 0.3 mm.

Inundations having a depth in a range of from 5 to 10 μm, as shown by arrow d in FIG. 8, are present on an upper surface of the plating layer 105. These inundations are inevitably generated during the plating process.

Figure 9:
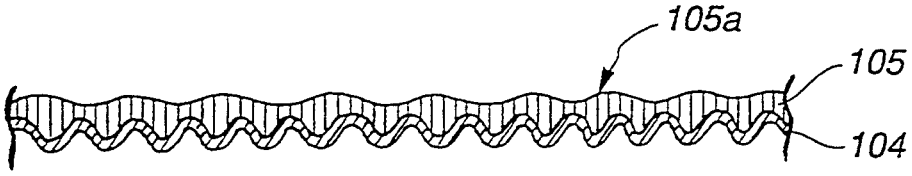
FIG. 9 shows the production process for producing a stamper for an optical disc wherein the state in which the plating layer has been peeled off from the synthetic resin layer is shown.
Figure 10:
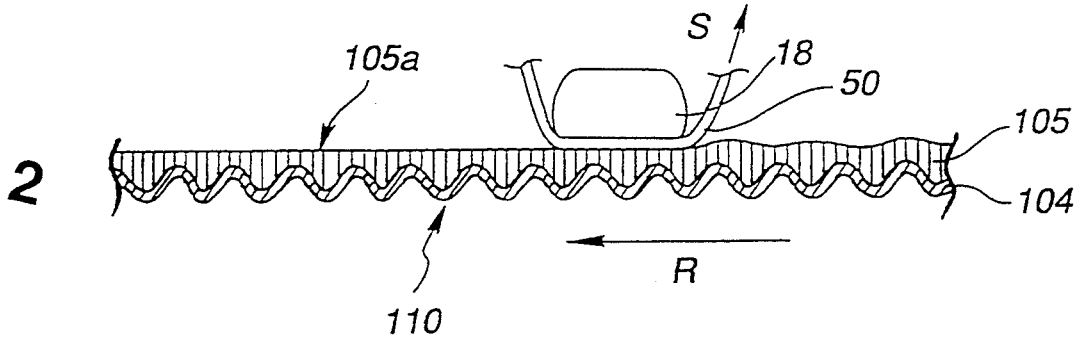
FIG. 10 shows the production process for producing a stamper for an optical disc wherein the state in which the reverse surface of the plating layer is ground for completing the stamper is shown.

As shown in FIG. 9, the metal layer 104 and the plating layer 105 are peeled off from the synthetic resin layer 102. The upper surface 105a of the plating layer 105 is ground by the grinding apparatus according to the present invention to provide a planar mirror surface free of the inundations, as shown in FIG. 10, to produce a stamper 110. The upper surface 105*a* of the plating layer 105 becomes a mounting surface of the stamper 110.

For grinding the mounting surface of the stamper 110, the stamper 110 is rotated in a direction shown by arrow R in FIG. 10 for bringing an abrasive tape 50 supported on an abrasive 18 as an abrasive member into sliding contact with the mounting surface of the stamper 110. The abrasive tape 50 is fed in a direction shown by arrow S in FIG. 10 by being guided by the abrasive roll 18.

The mounting surface of the stamper 110 is ground in this manner to prevent the stamper held in a metal mold unit for molding the disc substrate from being deformed by the inundations present on the mounting surface to assure smooth molding of the disc substrtate.

Figure 11:
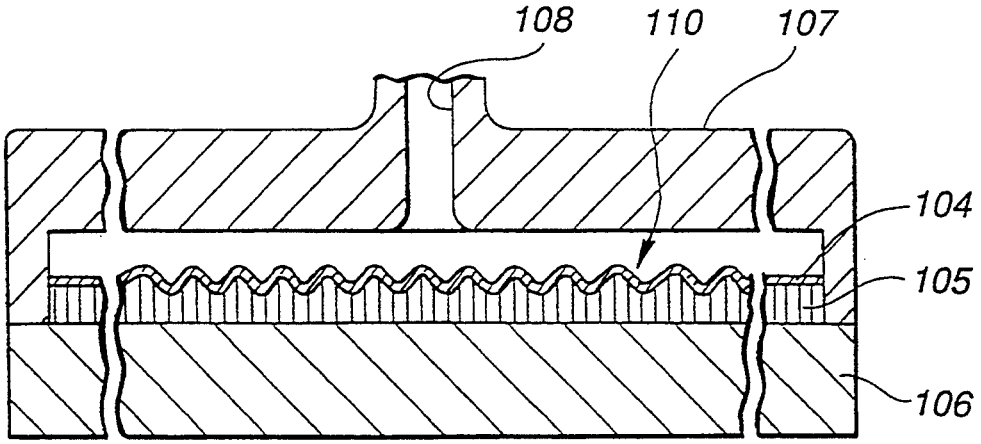
FIG. 11 shows a construction of a metal mold used for injection molding a disc substrate using the stamper.

Referring now to FIG. 11, the stamper 110 is set in an injection molding apparatus for molding the disc substrate on a planar upper surface of a lower mold 106 of the metal mold unit with the mounting surface supported by the lower metal mold 106. An upper mold 107 of the metal mold unit is adapted for being abutted on the lower mold 106. A cavity corresponding to the thickness of the disc substrate is formed between the upper metal mold 107 and the stamper 110.

The disc substrate is formed by injecting molten synthetic resin via a gate 108 into the cavity defined between the stamper 110 and the upper metal mold 107 under a predetermined injection pressure.

Figure 1:
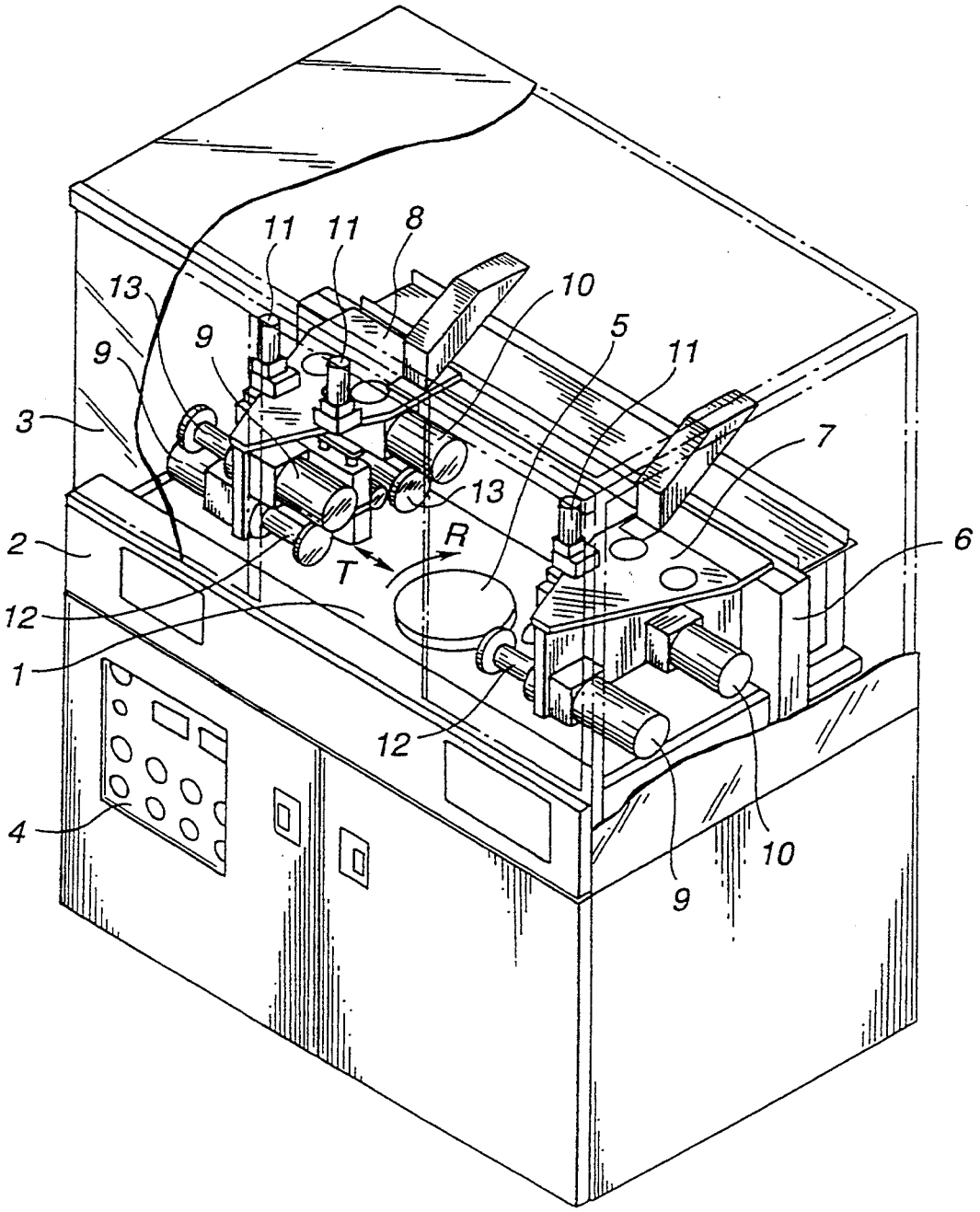
FIG. 1 is a perspective break-away view showing a construction of a stamper grinding apparatus according to the present invention.

Referring now to FIG. 1, the grinding apparatus according to the present invention includes an outer casing 2. A chassis 1 is provided at a mid part of the outer casing 2 for dividing the inside of the outer casing 2 into an upper portion and a lower portion. The upper portion of the outer casing 2 has an openable front door 3. The lower portion of the outer casing 2 below the chassis 1 houses a controller, not specifically shown, but indicated by a control panel 4. The controller includes an electronic circuit, such as a central processing unit (Cpu), not shown. The control panel 4 is provided on the front surface of the lower portion of the outer casing 2 for operating the controller.

Figure 2:
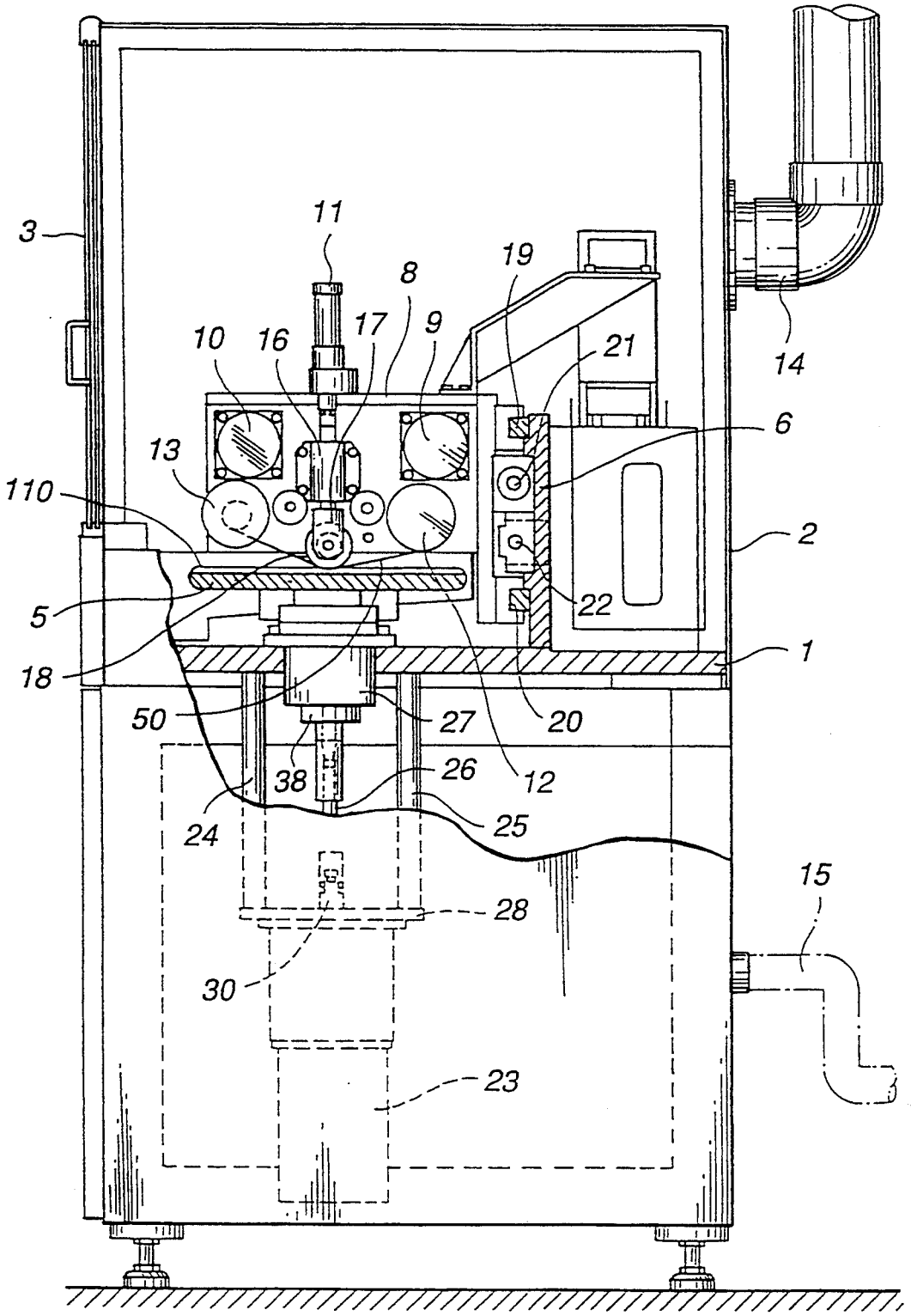
FIG. 2 is a side break-away view showing a construction of a stamper grinding apparatus according to the present invention.

Referring to FIG. 2, the outer casing also includes an air discharge duct 14 for maintaining a clean state within the outer casing 2 and a water duct system 15 for supplying and discharging cooling water, as shown in FIG. 2.

Figure 4:
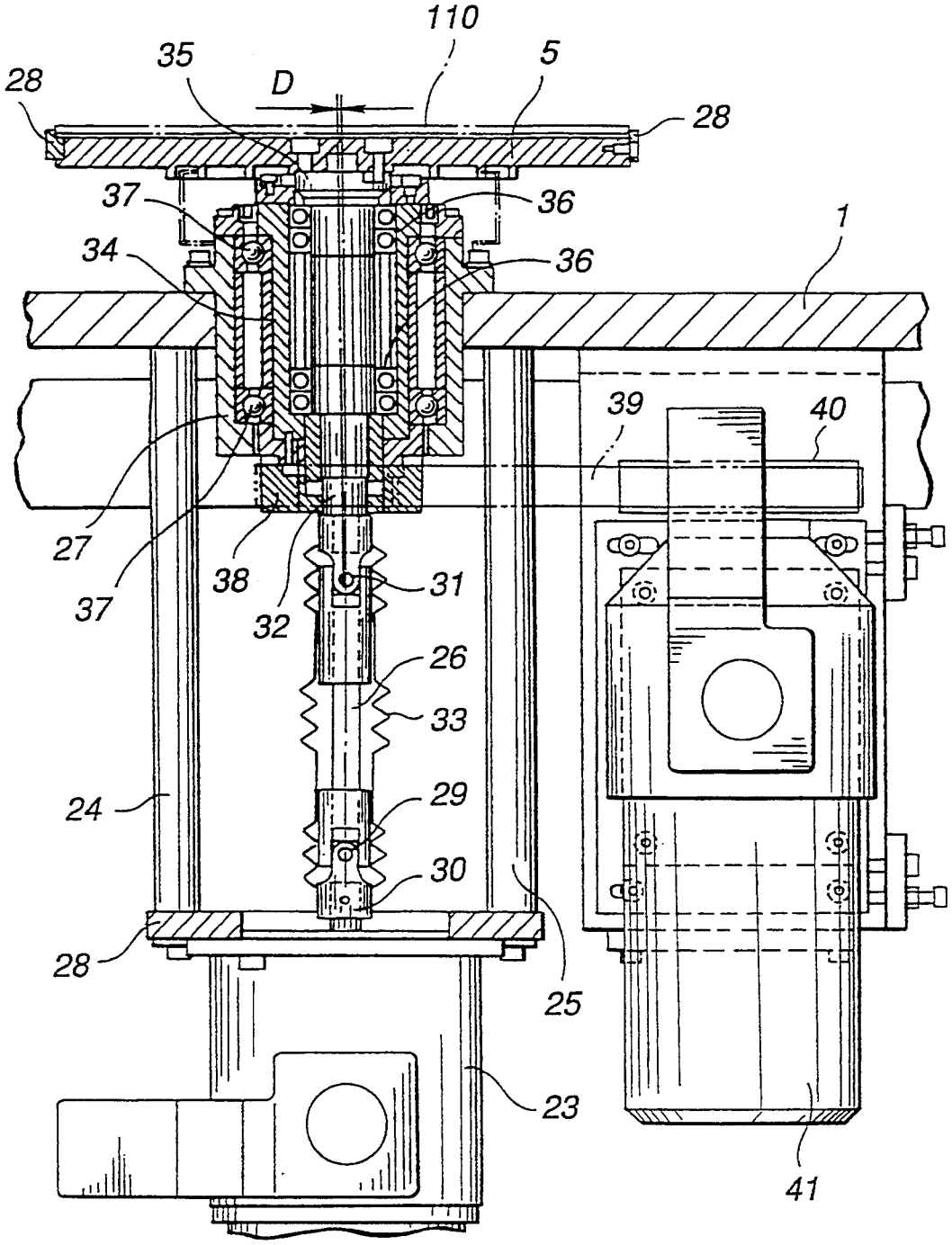
FIG. 4 is an enlarged longitudinal sectional view of a turntable of the stamper grinding apparatus shown in FIG. 1.

A turntable 5 on which the stamper 110 is set and rotated in unison therewith is provided on the chassis 1. The turntable 5 includes a plurality of stamper holders 28 around its periphery, as shown in FIG. 4. The turntable 5 is adapted to hold the stamper 110 by the stamper holders 28 with its mounting surface facing upwards.

The turntable 5 is mounted on a table support 35 on an upper end of a supporting shaft 32 mounted for rotation with respect to the chassis 1, so that the turntable 5 may be supported for rotation with respect to the chassis 1. The supporting shaft 32 has its axis substantially perpendicular to the chassis 1.

The supporting shaft 32 is supported with respect to the chassis by the interposition of an outer tubular member 27 and an inner tubular member 34. The outer tubular member 27 is fixedly mounted at a mid part of the chassis 1 by being fitted in an opening formed in the chassis 1. The outer tubular member 27 is substantially cylindrically-shaped and has its axis perpendicular to the chassis 1. The inner tubular member 34, which is similarly cylindrically-shaped, is fitted into and supported by the outer tubular member 27 via a pair of rotary bearings 37, 37. The inner tubular member 34 has an axis of a cylindrical surface forming its outer cylindrical surface coincident with the axis of the outer tubular member 27 so as to be rotated about the axis of the outer tubular member 27 with respect to the outer tubular member 27. The inner tubular member 34 is formed at its lower end with a belt pulley section 38 which is protruded downwards beyond the lower end of the outer tubular member 27 and which is coaxial with respect to the outer peripheral surface of the inner tubular member 34.

The cylindrical surface forming the inner periphery of the inner tubular member 34 is offset by a distance shown by arrow D in FIG. 4 with respect to a cylindrical surface forming an outer periphery of the inner tubular member 34. The axis of the cylindrical surface forming the inner periphery of the inner tubular member 34 runs parallel to the axis of the cylindrical surface forming the outer periphery of the inner tubular member 34. The supporting shaft 32 is rotatably supported within the inner tubular member 34 via a pair of rotary bearings 36, 36. That is, the supporting shaft 32 may be rotated about the axis of the inner tubular member 34 as the center of rotation, as indicated by arrow R in FIG. 1, while causing the axis of the inner tubular member 34 to be moved on a cylindrical locus having a distance corresponding to an offset between the inner and outer peripheries of the inner tubular member 34 as a radius.

The supporting shaft 32 is rotated via a countershaft 26 by a table motor 23 provided below the chassis 1. The table motor 23 is supported by the chassis 1 by means of a motor supporting shaft 28 mounted in turn via plural supporting posts 24, 25 on the lower surface of the chassis 1. The table motor 23 has its driving shaft 30 directed upwards towards the chassis 1 . The distal end of the driving shaft 30 is connected via a first universal joint 29 to the lower end of the countershaft 26, which has its upper end connected via a second universal joint 31 to the lower end of the supporting shaft 32. That is, supporting shaft 32 may be rotated by the table motor 23 even if the supporting shaft 32 is offset with respect to the driving shaft 30 by the rotation of the inner tubular member 34 with respect to the outer tubular member 27. The table motor 23 is rotationally driven under a rotational velocity controlled by the controller. Meanwhile, the countershaft 26 is enclosed within a bellows 33 formed of synthetic resin.

The inner tubular member 34 is rotated with respect to the outer tubular member 27 by an offset-driving motor 41, provided below the chassis 1, via an endless driving belt 39 and the belt pulley section 38. The offset-driving motor 41 is fixed by a support, not shown, to the lower surface of the chassis 1. A belt pulley 40 is mounted on a driving shaft of the offset-driving motor 41. An endless driving belt 39 is placed around the belt pulley 40 and the belt pulley section 38 of the inner tubular member 34. The offset-driving motor 41 is rotationally driven under control by the controller.

The present grinding apparatus for grinding the stamper comprises a first abrasive head 7 and a second abrasive head 8 for supporting the abrasive tape 50, which is to be an abrasive member for grinding the mounting surface of the stamper 110 held on the turntable 5. The abrasive tape 50 comprises hard abrasive grains affixed to a tape-shaped substrate.

Figure 3:
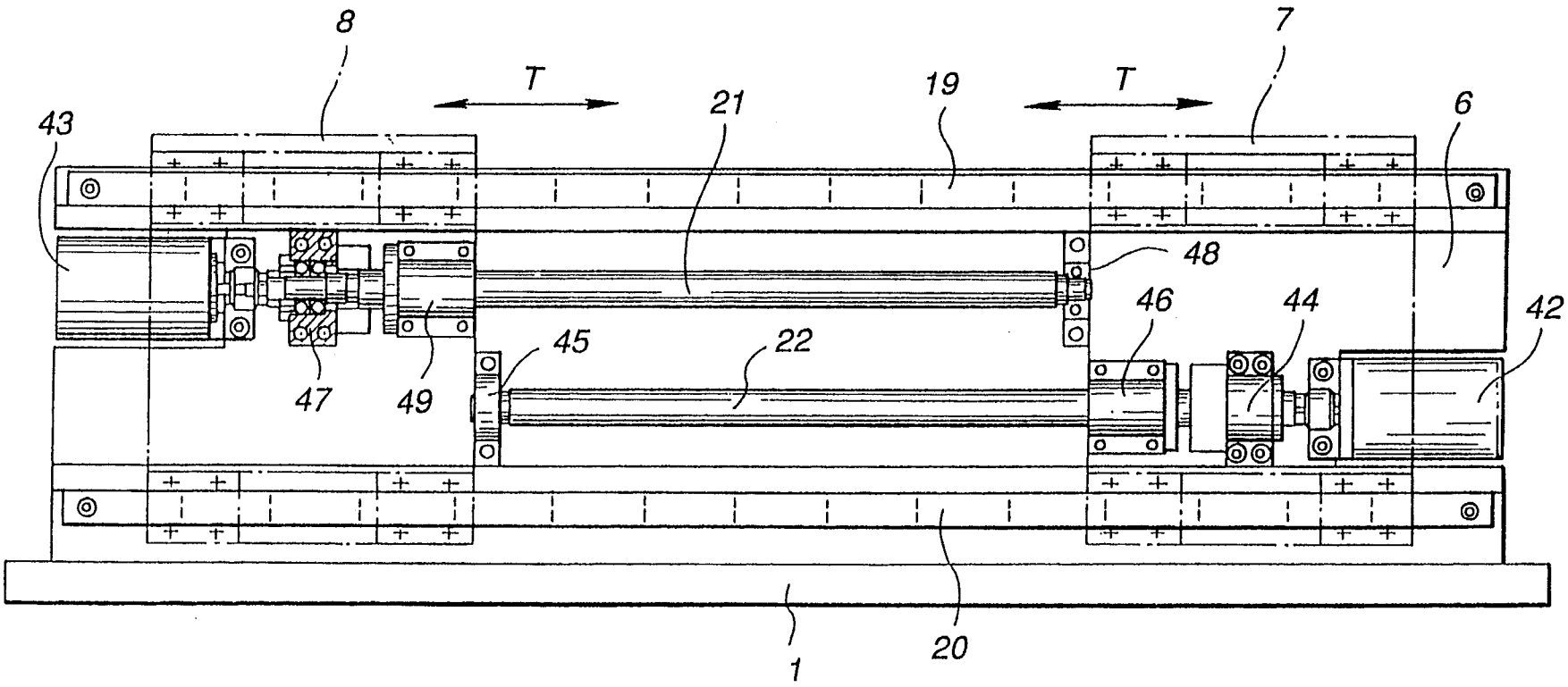
FIG. 3 is an enlarged front view of an abrasive head feed device of the stamper grinding apparatus shown in FIG. 1.

Each of the abrasive heads 7, 8 comprises a backbone plate supported for movement on the chassis 1 by an abrasive head supporting plate 6 mounted at back of the turntable 5 on the chassis 1 . That is, the abrasive head supporting plate 6 is formed substantially as a vertically extending wall member carrying a pair of supporting rails 19, 20 on its front surface (i.e., facing the turntable). The backbone plates of the abrasive heads 7, 8 are supported by supporting rails 19, 20 so as to be moved on the chassis 1 parallel to the chassis 1 as indicated by arrow T in FIGS. 1 and 3.

The first abrasive head 7 is moved along the supporting rails 19, 20 by a first head feed motor 42 mounted on the abrasive head supporting plate 6. That is, the first head feed motor 42 is adapted for rotationally driving a first screw shaft 22 rotatably mounted on the abrasive head supporting plate 6 via a pair of bearings 44, 45. The first screw shaft 22 is mounted parallel to the supporting rails 19, 20. The first screw shaft 22 meshes with a first screw ring 46 mounted at the proximal end of the backbone plate of the first abrasive head 7. When the first screw shaft 22 is rotated, the first screw ring 46 is fed along the axis of the first screw shaft 22 along with the first screw head 7.

The second abrasive head 8 is similarly moved along the supporting rails 19, 20 by a second head feed motor 43 mounted on the abrasive head supporting plate 6. That is, the second head feed motor 43 is adapted for rotationally driving a second screw shaft 21 rotatably mounted on the abrasive head supporting plate 6 via a pair of bearings 48, 49. The second screw shaft 21 is mounted parallel to the supporting rails 19, 20. The second screw shaft 21 meshes with a second screw ring 49 mounted at the proximal end of the backbone plate of the second abrasive head 8. When the second screw shaft, 21 is rotated, the second screw ring 49 is fed along the axis of the second screw shaft 21 along with the second screw head 8.

Meanwhile, each of the head feed motors 42, 43 is a so-called stepping motor which may be rotated stepwise by an angle which is controllable and detactable in a known manner. These head feed motors 42, 43 are rotationally driven by being controlled by the controller as to their rotational velocity and angle of stepwise rotation.

The abrasive heads 7, 8 are adapted for causing the abrasive tape 50 to bear on the mounting surface of the stamper 110 set on the turntable 5 under a predetermined contact pressure.

That is, referring to FIG. 2, a supply reel 12 and a takeup reel 13 are mounted for rotation on the backbone plate of the first abrasive head 7. The supply reel 12 and the takeup reel 13 are arrayed parallel to the chassis 1 and supported with their axes extending parallel to each other. The takeup reel 13 is rotated by a takeup motor 10 mounted on the backbone plate of the first abrasive head 7. The supply reel 12 is adapted for being rotated under a predetermined load by a torque motor 9 mounted on the backbone plate 9 of the first abrasive head 7.

An abrasive roll 18 is mounted between the supply reel 12 and the takeup reel 13. The abrasive roll 18 is formed e.g. of rubber and mounted for rotation on the lower end of a roll supporting bar 17 mounted via a supporting tube 16 on the backbone plate of the first abrasive head 7. The roll supporting bar 17 is supported substantially at eight angles to the chassis 1 for reciprocation in a vertical direction, that is in a direction towards and away from the chassis 1. A hydraulic cylinder unit 11, mounted on the backbone plate of the first abrasive head 7, is mounted on the upper end of the roll supporting bar 17. The hydraulic cylinder unit 11 is adapted for vertically moving the roll supporting bar 17.

The abrasive tape 50 is wound on the supply reel 12 and thence wound on the takeup reel 13 by way of the lower side of the abrasive roll 18. On rotation of the takeup reel 13 by rotation of the takeup motor 10, the abrasive tape 50 is reeled out from the supply reel 12 so as to be taken up by the takeup reel 13 via abrasive roll 18 as a guide. Since the supply reel 12 is rotated under a certain load with respect to rotation by the torque motor, the abrasive tape 50 is placed under a predetermined tension.

On the other hand, a pair of supply reels 12, 12 and a pair of takeup reels 13, 13 are mounted for rotation on both lateral sides of the backbone plate of the second abrasive head 8. The supply reels 12, 12 and the takeup reels 13, 13 are arrayed parallel to the chassis 1 and supported with their axes extending parallel to each other. The takeup reels 13, 13 are rotated by takeup motors 10, 10 mounted on the backbone plate of the second abrasive head 8. The supply reels 12, 12 are adapted for being rotated under a predetermined load by torque motors 9, 9 mounted on the backbone plate of the second abrasive head 8.

An abrasive roll 18 is mounted between the supply reel 12 and the takeup reel 13 on one surface of the backbone plate of the second abrasive head 8. Another abrasive roll 18 is mounted between the supply reel 12 and the takeup reel 13 on the other surface of the backbone plate of the second abrasive head 8. These abrasive rolls are formed e.g. of rubber and mounted for rotation on the lower ends of roll supporting bars 17, 17 mounted via supporting tubes 16, 16 on the backbone plate of the second abrasive head 8. These roll supporting bars 17, 17 are supported substantially at right angles to the chassis 1 for reciprocation in a vertical direction, that is in a direction towards and away from the chassis 1. The abrasive rolls 18, 18 are mounted with their axes extending parallel to the chassis 1. Hydraulic cylinder units 11, 11, mounted on the backbone plate of the second abrasive head 8, are mounted on the upper ends of the roll supporting bars 17, 17. These hydraulic cylinder units 11, 11 are adapted for vertically moving the roll supporting bars 17, 17.

With the second abrasive head 8, similarly to the first abrasive head 7, abrasive tapes 50, 50 are wound on the supply reels 12, 12, so as to be wound on the takeup reels 13, 13 by way of the lower sides of the abrasive rolls 18, 18. On rotation of the takeup reels 13, 13, caused by rotation of the takeup motors 10, 10, the abrasive tapes 50, 50 are reeled out from supply reels 12, 12 so as to be taken up by the takeup reels 13, 13 by being guided by the abrasive rolls 18, 18.

The takeup motors 10, 10 are rotationally driven at the speeds of rotation controlled by the above-mentioned controller.

The abrasive tape 50 of the first abrasive head 7 is a finishing abrasive tape by which the grinding process for the mounting surface of the stamper 110 is to be completed. The abrasive tape 50 supported by the surface of the backbone plate of the second abrasive head 8 facing the first abrasive head 7 is a semi-finishing abrasive tape having abrasive grains of a larger diameter than that of the abrasive grains of the finishing abrasive tape 50. The abrasive tape 50 supported by the opposite surface of the backbone plate of the second abrasive head 8 is a rough finishing abrasive tape having abrasive grains of a larger diameter than that of the abrasive grains of the semi-finishing abrasive tape 50.

When the abrasive heads 7, 8 are moved along the supporting rails 19, 20, the abrasive surfaces of the abrasive tapes 50, 50, 50, or more precisely, the lower surfaces of the portions of the abrasive tapes guided by the abrasive roll 18, are moved in a direction towards and away from the center of rotation of the turntable 5 and in a direction parallel to the mounting surface of the stamper 110 held on the turntable 5, that is, in a direction across the inner and outer peripheries of the stamper 110.

With the above-described stamper grinding apparatus according to the present invention, when the stamper 110 is rotated by table motor 23 with the abrasive surface of the abrasive tape 50 in pressure contact with the mounting surface of the stamper 110 held on the turntable 5, the abrasive tape 50 is brought into sliding contact with the mounting surface of the stamper 110 for grinding the mounting surface. At this time, the contact pressure between the stamper 110 and the abrasive tape 50 is adjusted to a predetermined value by the hydraulic cylinder 11. The abrasive surface of each abrasive tape 50 is moved at a predetermined constant velocity across the inner and outer peripheries of the stamper 110 for grinding the mounting surface of the stamper 110 in its entirety.

Meanwhile, since each abrasive tape 50 is worn out with the grinding of the stamper 110, the abrasive tape is fed at a constant speed so that used-up portions of the tape 50 are taken up on the takeup reels 13, 13, 13 and unused portions thereof are brought into sliding contact with the stamper 110 for grinding the mounting surface of the stamper 110.

It is noted that, in the present grinding apparatus, the above-mentioned controller plays the part of a grinding position detecting means for detecting the position on the stamper 110 of the abrasive heads 7, 8 based on driving pulses transmitted to the head feed motors 42, 43. The control let controls the rotational speed of the table motor 23 based on the detected position on the stamper 110 of the abrasive heads 7, 8. More precisely, the controller controls the rotational speed of the table motor 23, and therefore the rotational speed of the turntable 23, so that the relative sliding speed between the stamper 11 and the abrasive tape 50 is substantially constant. That is, the controller controls the rotational speed of the turntable 5 so that the closer the grinding position of the first or second abrasive head 7 or 8 to the inner and outer peripheries of the stamper 110, the higher and the lower becomes the rotational speed of the turntable 5, respectively.

Figure 12:
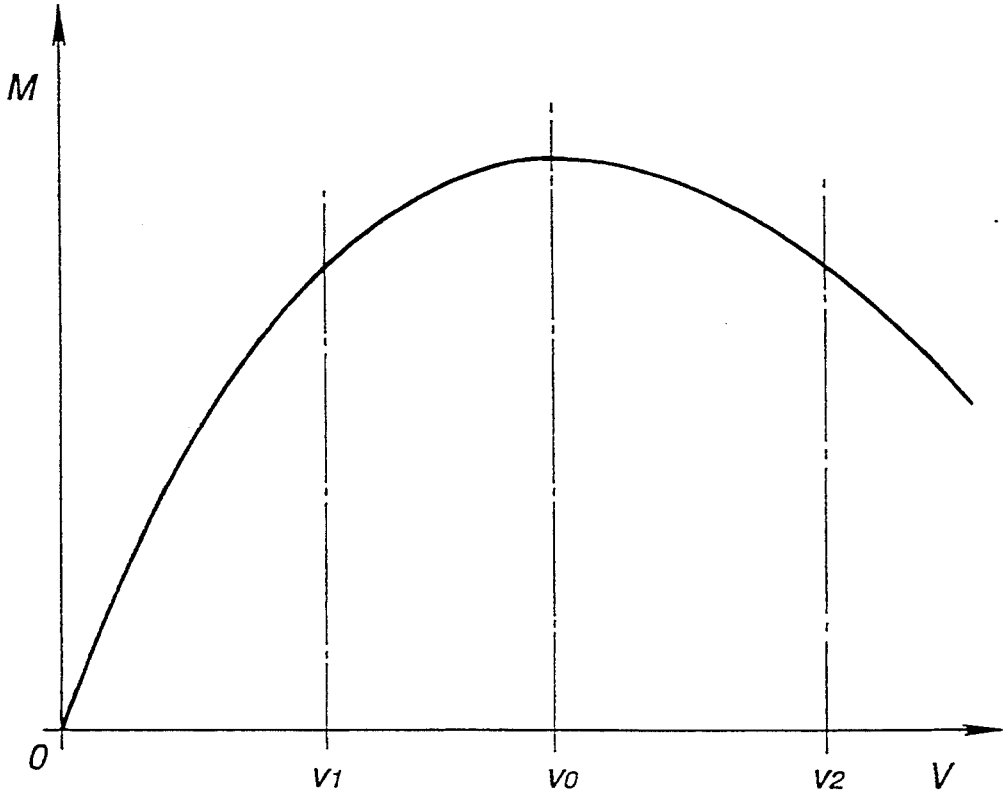
FIG. 12 is a chart showing the relation between the relative speed of sliding movement between the stamper and the abrasive member and the amount of grinding of the stamper.

Consequently, with the present stamper grinding apparatus, the relative speed of sliding contact between the mounting surface of the stamper 110 and the grinding surface of the abrasive surface of the abrasive tape 50 may be maintained substantially constant or changed only within a preset range across the inner and outer peripheries of the slapper 110. It is noted that, with the relative speed V between the stamper 110 and the abrasive tape 50 and the amount of grinding M of the stamper 110 per unit time, these variables V and M are related to each other in a manner as shown in FIG. 12, that is, such that the amount of grinding M becomes locally maximum at a preset speed $v_0$. That is, the amount of grinding M becomes smaller than that for the preset speed $v_0$ both when the speed V is higher than the preset speed $v_0$ and when the speed V is lower than the preset speed $v_0$.

If the turntable 5 is rotated at a constant angular velocity, the relative speed of sliding contact V between the mounting surface of the stamper 110 and the abrasive surface of the abrasive tape 50 is changed across the inner most region and the outer most region of the stamper 110 between a speed $v_1$ lower than the preset speed $v_0$ and a speed $v_2$ higher than the preset speed $v_0$. Consequently, in such a case, the mounting surface of the stamper 110 cannot be ground uniformly in its entirety. With the stamper grinding apparatus of the present invention, the relative speed of sliding contact V may be maintained substantially at the above-mentioned preset speed $V_0$ over the entire surface of the stamper 110 so that the entire mounting surface of the stamper 110 may be ground under a constant condition.

Furthermore, with the present stamper grinding apparatus, the offset-driving motor 41 is rotationally driven at a constant angular velocity during the grinding process of the mounting surface of the stamper 110. Consequently, the turntable 5 is moved in such a manner that its center of rotation is moved on a circular locus having an axis of rotation of the driving shaft 30 of the table motor 23 as center. The result is that the locus of movement of the abrasive surface of the abrasive tape 50 on the mounting surface of the stamper 10 is wobbled towards the inner and outer peripheries of the stamper 110 with respect to an arc of a circle having the center of the stamper 110 as a center.

The locus of movement of the abrasive surface of the abrasive tape 50 with respect to the stamper 110 is wobbled in this manner in order to raise the grinding efficiency for the stamper 110. With the stamper grinding apparatus, since the table motor 23 is control led in this manner by the above-mentioned control let, the locus of movement of the abrasive surface with respect to the stamper 110 is wobbled with a constant wave shape across the inner and the outer peripheries of the stamper 110. The result is that a high grinding efficiency may be maintained over the entire surface of the stamper 110 to improve durability of the stamper 110.

Furthermore, with the present stamper grinding apparatus, the entire surface of the stamper 110 may be ground with a high grinding efficiency, so that consumption of the abrasive tape 50 per unit grinding area may be diminished.

What is claimed is:

1. A grinding apparatus for grinding a stamper comprising a turntable for holding and rotating the stamper, driving means for rotating the turntable, first abrasive means movable along a first radius of said stamper, said first abrasive means slidingly contactable with a mounting surface of said stamper, second abrasive means movable along a second radius of said stamper, said second abrasive means slidingly contactable with said mounting surface of said stamper, grinding position detecting means for detecting a first position of said first abrasive means on the stamper and a second position of said second abrasive means on the stamper, controlling means for controlling the rotational speed of said turntable based on the first and second positions as detected by said grinding position detecting means, and wherein said first abrasive means is movable by a feed motor and said second abrasive means is movable by a feed motor.

2. A grinding apparatus as defined in claim 1 wherein:

an abrasive tape of said first abrasive means has fine abrasive grains of a first diameter affixed on a substrate and an abrasive tape of said second abrasive means has fine abrasive grains of a second diameter affixed on a substrate.

3. A grinding apparatus for grinding a stamper employed for forming a signal recording part of an information signal recording disc, comprising:

a turntable for holding and rotating the stamper carrying thereon projections and recesses for subsequent molding of a correspondingly shaped signal recording surface of the information signal recording disc;

rotating driving means for rotationally driving the turntable;

a pair of abrasive means moved along the radius of the stamper held on and rotated by the turntable for being slidingly contacted with a mounting surface of the stamper, the pair of abrasive means being supported for movement radially of the stamper by supporting rails and moved by a feed motor;

wherein each of the abrasive means include an abrasive tape mounted and travelling between a supply reel and a takeup reel, and an abrasive roll positioned between the supply reel and the takeup reel and moved in a direction perpendicular to and towards and away from the mounting surface of the stamper held on the turntable, the abrasive roll bringing the abrasive tape travelling between the supply reel and the takeup reel into sliding contact with the mounting surface of the stamper, and further wherein an abrasive tape of one of the pair of abrasive means has fine abrasive grains affixed on a first substrate and the abrasive tape of the other one of the pair of abrasive means has semifine abrasive grains, which have a larger diameter than the diameter of the fine abrasive grains, affixed on a second substrate;

grinding position detecting means for detecting a position of the pair of abrasive means on the stamper; and controlling means for controlling the rotational speed of the turntable based on the position of the pair of abrasive means on the stamper as detected by the grinding position detecting means.

4. A grinding apparatus for grinding a stamper employed for forming a signal recording part of an information signal recording disc, comprising:

a turntable for holding and rotating the stamper carrying thereon projections and recesses for subsequent molding of a correspondingly shaped signal recording surface of the information signal recording disc;

rotating driving means for rotationally driving the turntable about an axis passing through the center of the stamper held on the turntable and perpendicular to the major surface of the stamper;

movement means for moving the turntable in a plane parallel to the major surface of the stamper held on the turntable for causing the center of the turntable to describe an arcuate locus;

abrasive means moved along the radius of the stamper held on and rotated by the turntable for being slidingly contacted with a mounting surface of the stamper;

grinding position detecting means for detecting a position of the abrasive means on the stamper, and controlling means for controlling the rotating driving means to control the rotational speed of the turntable based on the position of the abrasive means on the stamper as detected by the grinding position detecting means.

5. A grinding apparatus as defined in claim 4 wherein:

said turntable is connected to a driving shaft of a turntable driving motor with an offset with respect to a center of rotation.

6. A grinding apparatus as defined in claim 4 wherein said rotating driving means comprises:

a turntable driving motor, a rotation supporting shaft for supporting the center of the turntable, and a pair of universal joints connecting a driving shaft of the turntable driving motor to said rotation supporting shaft.

7. A grinding apparatus as defined in claim 4 wherein said movement means comprises an inner tubular member rotatably supported by an outer tubular member secured to a chassis, said supporting shaft for said turntable being rotatably inserted through said inner tubular member, and rotating and driving means for rotationally driving said inner tubular member, said inner tubular member having an inner tubular surface offset with respect to a cylindrical outer surface of the tubular member.

* * * * *